US011105495B2

(12) United States Patent
Jiang

(10) Patent No.: US 11,105,495 B2
(45) Date of Patent: Aug. 31, 2021

(54) STAGE LIGHT SHADING DEVICE

(71) Applicant: GUANGZHOU HAOYANG ELECTRONIC CO., LTD, Guangdong (CN)

(72) Inventor: Weikai Jiang, Guangdong (CN)

(73) Assignee: GUANGZHOU HAO YANG ELECTRONIC CO., LTD, Guangdong (CN)

( * ) Notice: Subject to any disclaimer, the term of this patent is extended or adjusted under 35 U.S.C. 154(b) by 49 days.

(21) Appl. No.: 16/338,467

(22) PCT Filed: Jun. 26, 2018

(86) PCT No.: PCT/CN2018/092931
§ 371 (c)(1),
(2) Date: Mar. 30, 2019

(87) PCT Pub. No.: WO2019/001432
PCT Pub. Date: Jan. 3, 2019

(65) Prior Publication Data

US 2020/0032991 A1 Jan. 30, 2020

(30) Foreign Application Priority Data

Jun. 27, 2017 (CN) ..... 201720756432.4

(51) Int. Cl.
*F21V 17/02* (2006.01)
*F21V 11/02* (2006.01)
(Continued)

(52) U.S. Cl.
CPC ..... *F21V 21/30* (2013.01); *F21V 11/02* (2013.01); *F21V 11/08* (2013.01); *F21V 14/08* (2013.01);
(Continued)

(58) Field of Classification Search
CPC ..... F21V 21/30; F21V 11/02; F21V 14/08; F21W 2131/406
See application file for complete search history.

(56) References Cited

U.S. PATENT DOCUMENTS 5,997,187 A * 12/1999 Hamasaki ..... G03B 9/24 396/449
6,811,331 B2 * 11/2004 Iwasa ..... G03B 9/08 396/449
(Continued)

FOREIGN PATENT DOCUMENTS

CN 203215573 U 9/2013
CN 203823665 U 9/2014
(Continued)

*Primary Examiner* — Arman B Fallahkhair
(74) *Attorney, Agent, or Firm* — Muncy, Geissler, Olds and Lowe, P.C.

(57) ABSTRACT

A stage light shading device includes a light shade, light shade adjustment wheels for adjusting a shading pattern of the light shade, a cover plate, an elastic fastening component provided on the cover plate and used for fixing the light shade adjustment wheels, and a connector coupled with the light shade provided on the cover plate. The stage light shading device can plug and play, quickly realize the shade of stage light, and is flexible and convenient to operate, preventing the light shade adjustment wheels from misoperation due to accidental contact or vibration of the stage light itself, so that a stable and reliable shading pattern can be obtained.

10 Claims, 2 Drawing Sheets

(51) Int. Cl.

| | |
|---|---|
| ***F21V 21/30*** | (2006.01) |
| ***F21V 14/08*** | (2006.01) |
| ***F21V 11/08*** | (2006.01) |
| *F21W 131/406* | (2006.01) |
| *F21S 10/00* | (2006.01) |

(52) U.S. Cl.
CPC ..... *F21S 10/007* (2013.01); *F21V 17/02* (2013.01); *F21W 2131/406* (2013.01)

(56) References Cited

U.S. PATENT DOCUMENTS

| | | | | |
|---|---|---|---|---|
| 7,259,922 | B2 * | 8/2007 | Fukasawa | G03B 9/06 348/E9.027 |
| 8,950,904 | B2 * | 2/2015 | Cavenati | F21V 11/18 362/319 |
| 9,366,415 | B2 * | 6/2016 | Jurik | F21V 11/18 |
| 2012/0230039 | A1 * | 9/2012 | Hansen Ellevang | F21V 14/08 362/351 |
| 2013/0039075 | A1 * | 2/2013 | Dalsgaard | F21V 14/08 362/321 |

FOREIGN PATENT DOCUMENTS

| | | | |
|---|---|---|---|
| CN | 203823683 | U | 9/2014 |
| CN | 207034995 | U | 2/2018 |
| JP | 2000195305 | A | 7/2000 |
| JP | 2003151304 | A | 5/2003 |

* cited by examiner

STAGE LIGHT SHADING DEVICE

TECHNICAL FIELD

The utility model relates to the technical field of stage light shading, in particular to a stage light shading device.

BACKGROUND ART

In the practical application of stage lights, the patterns projected by the lights need to be cut to meet the needs of different customers and situations, and a light shade needs to be configured on the device. In order to save costs and simplify the structure, a plug-and-play light shade which uses a manually adjustment structure to drive shading blades to obtain the desired pattern is configured in many occasions. The adjustment structure only relies on the riveting tightness between its own components to prevent the shading blades from moving after adjustment under normal conditions. However, the approach can be invalid with the increase in the number of use on the one hand, and on the other hand, the moving of the shading blades can be caused by the accidental contact with the adjustment wheel or the vibration of the device itself, and leads to a pattern change.

SUMMARY OF THE INVENTION

The utility model aims to overcome the defects of the prior art based on the above description, and provides a stage light shading device which avoids misoperation. The stage light shading device is simple in structure and convenient to operate, and can plug and play and effectively prevent the shading blades from moving due to accidental contact or vibration of the device itself.

Another object of the utility model is to provide a stage light.

The technical scheme is as follows.

A stage light shading device includes a light shade, light shade adjustment wheels for adjusting a shading pattern of the light shade, a cover plate, and an elastic fastening component provided on the cover plate and used for fixing the light shade adjustment wheels, in which the cover plate is detachably coupled with the light shade.

The utility model provides an elastic fastening component on the cover plate. When the cover plate is open, the light shade adjustment wheels are in a free state, and the operator can obtain the required shading pattern by operating the light shade adjustment wheels. When the cover plate is closed, due to the fact that the cover plate is provided with the elastic fastening component for fixing the light shade adjustment wheels, the light shade adjusting wheels can be fixed to prevent the light shade adjustment wheels from moving, that is, preventing the light shade adjustment wheels from misoperation due to accidental contact or vibration of the stage light itself, so that a stable and reliable shading pattern can be obtained.

In one of the embodiments, the cover plate is rotatably coupled with the light shade, and a connector coupled with the light shade is provided on the cover plate.

In one of these embodiments, the elastic fastening component is an elastic pressing strip. The elastic pressing strip is good in elasticity, low in cost and convenient to install, and when the cover plate is closed, the elastic pressing strip fixes and presses the light shade adjustment wheels tightly with the elasticity.

In one of the embodiments, the elastic pressing strip is a silicone elastic pressing strip, a rubber elastic pressing strip or an elastomer pressing strip.

In one of the embodiments, the elastic pressing strip has a thickness of 0.5 to 5 mm. The selection of the elastic pressing strip with a thickness of 0.5 to 5 mm can create a better fixing and pressing effect of the pressing strip on the light shade adjustment wheels.

In one of the embodiments, the light shade includes: a panel, a sandwiched plate, and a bottom plate, which are sequentially provided in a layered relationship through a connecting pole. A first light passing hole, a second light passing hole and a third light passing hole, which are used for a light beam to pass through, are respectively provided on the panel, the sandwiched plate and the bottom plate. Shading blades and a linkage mechanism are provided on the panel, and the light shade adjustment wheels drive the shading blades through the linkage mechanism to move and cover the third light passing hole to form the shading pattern. The light beam can form a circular light spot through the first light passing hole, the second light passing hole and the third light passing hole, and the light shade adjustment wheels drive the shading blades to move and cover the third light passing hole on the bottom plate through the linkage mechanism to form the shading pattern so as to achieve the shading of stage light.

In one of the embodiments, the number of the shading blades is four and the shading blades are symmetrically provided.

In one of the embodiments, a gasket is respectively provided between the panel and the sandwiched plate, and the sandwiched plate and the bottom plate. The panel, the sandwiched plate and the bottom plate can be assembled to have a compact structure by arranging the gasket.

In one of the embodiments, the number of the light shade adjustment wheels is eight. The eight light shade adjustment wheels are divided into four groups which respectively control the four shading blades.

A stage light includes a light source and the stage light shading device corresponding to the light source.

The beneficial effects of the utility model are as follows:

(1) In the utility model, the elastic fastening component for fixing the light shade adjustment wheels is provided on the cover plate of the light shade, which can prevent the light shade adjustment wheels from moving, that is, preventing the light shade adjustment wheels from misoperation due to accidental contact or vibration of the stage light itself, so that a stable and reliable shading pattern can be obtained;

(2) The elastic pressing strip is selected to serve as the elastic fastening component, which has better elasticity, lower cost, and is convenient to install;

(3) The stage light shading device of the utility model can plug and play, quickly realize the shading of stage light, and is flexible and convenient to operate with obvious stability effect.

DESCRIPTION OF REFERENCE NUMERALS

1. light shade; 2. light shade adjustment wheel; 3. rotating shaft; 4. cover plate; 5. pressing strip; 6. connector; 11. panel; 12. sandwiched plate; 13. bottom plate; 14. connecting pole; 15. shading blade; 16. linkage mechanism; 111. first light passing hole; 121. second light passing hole; 131. third light passing hole.

BEST MODE FOR CARRYING OUT THE INVENTION

In order to make the object, the technical scheme and the advantages of the invention more clear, the invention will be described in detail below with reference to the accompanying drawings and an embodiment. It should be understood that the embodiment described herein are merely exemplary and does not limit the scope of the invention.

Figure 1:
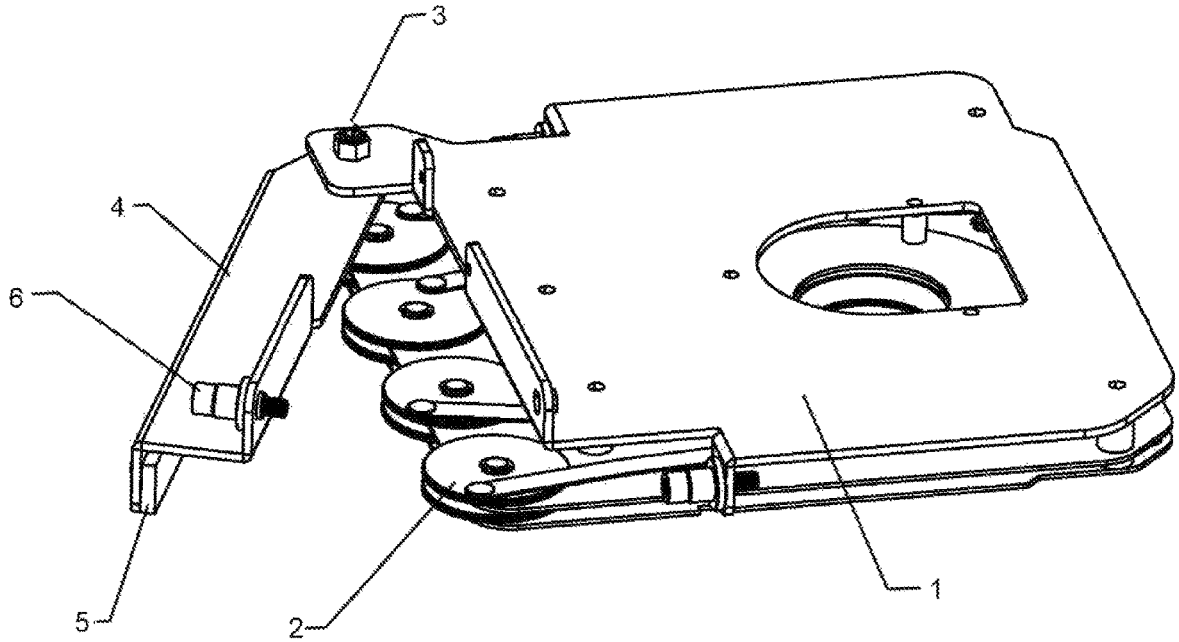
FIG. 1 is a schematic view of the overall structure of the stage light shading device when the cover plate is in an open state.
Figure 2:
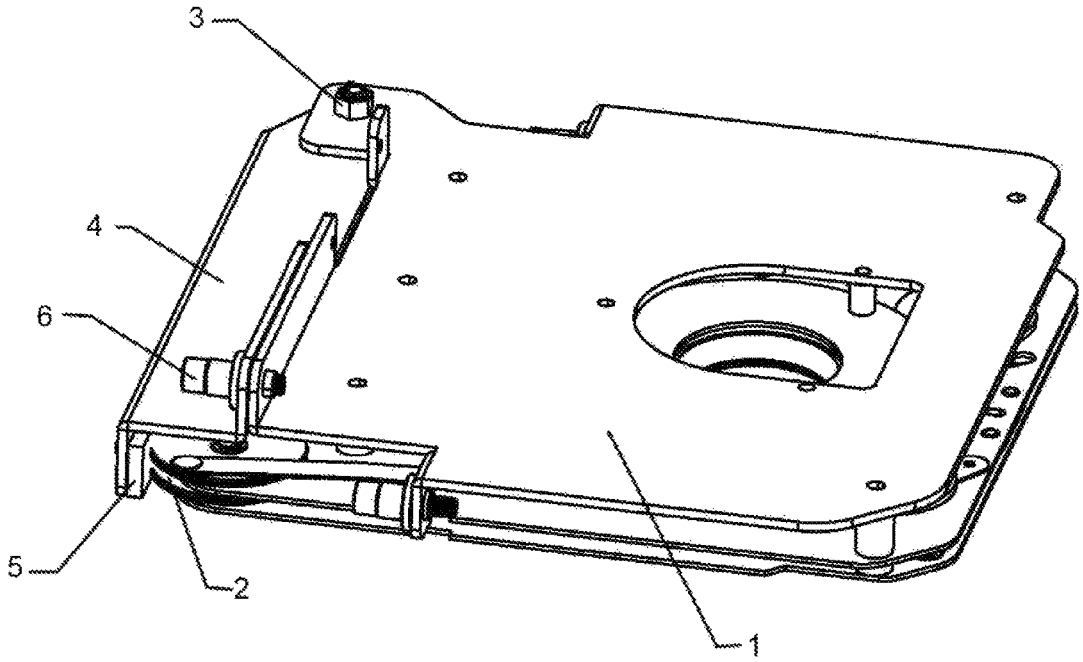
FIG. 2 is a schematic view of the overall structure of the stage light shading device when the cover plate is in a closed state.

As shown in FIGS. 1 and 2, stage light shading device of the utility model includes a light shade 1, light shade adjustment wheels 2 for adjusting the shading pattern of the light shade, a cover plate 4, and an elastic fastening component 5 provided on the cover plate 4 and used for fixing the light shade adjustment wheels 2, in which the cover plate 4 is detachably coupled with the light shade 1.

The cover plate 4 is rotationally coupled with the light shade 1, and a connector 6 coupled with the light shade is provided on the cover plate 4.

The cover plate 4 is connected with the light shade 1 through a rotating shaft 3. The elastic fastening component 5 is an elastic pressing strip. The elastic pressing strip can be a silicone elastic pressing strip, a rubber elastic pressing strip or an elastomer pressing strip, and is good in elasticity and fixes and presses the light shade adjustment wheels tightly with the elasticity. The cover plate 4 rotates around the rotating shaft 3 to realize opening and closing of the cover plate 4. When the cover plate 4 is open, the adjustment wheels 2 are in a free state, and the desired shading pattern can be obtained by operating the adjustment wheels 2. When the cover plate 4 is closed, the pressing strip 5 on the cover plate 4 presses against the adjustment wheels 2 which are fixed by the elasticity of the pressing strip to prevent the adjustment wheels 2 from misoperation and to obtain a stable shading pattern.

Figure 3:
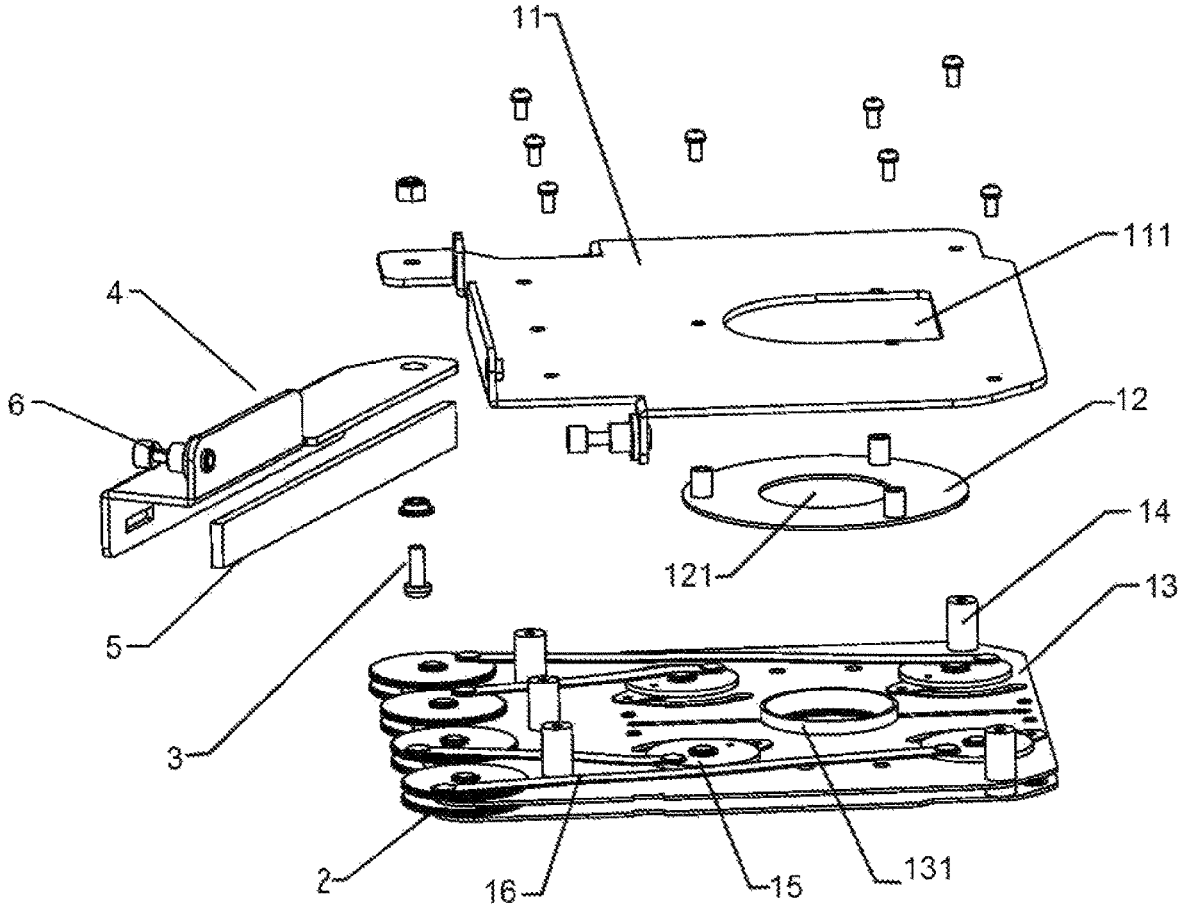
FIG. 3 is an exploded view of the light shade.

As shown in FIG. 3, the light shade 1 includes: a panel 11, a sandwiched plate 12 and a bottom plate 13, which are sequentially provided in a layered relationship through a connecting pole 14 wherein the connecting pole can be a riveting pole or a screw. A first light passing hole 111, a second light passing hole 121 and a third light passing hole 131, which are used for the light beam to pass through, are respectively provided on the panel 11, the sandwiched plate 12 and the bottom plate 13. Four shading blades 15 and a linkage mechanism 16 are provided on the bottom plate 13, and the light shade adjustment wheels 2 drive the shading blades 15 through the linkage mechanism 16 to move and cover the third light passing hole 131 to form the shading pattern. The light beam can form a circular light spot through the first light passing hole, the second light passing hole and the third light passing hole, and the light shade adjustment wheels drive the shading blades to move and cover the third light passing hole on the bottom plate through the linkage mechanism 16 to form the shading pattern so as to achieve the shading of stage light.

Further, a gasket is respectively provided between the panel 11 and the sandwiched plate 12, and the sandwiched plate 12 and the bottom plate 13. The panel, the sandwiched plate and the bottom plate can be assembled to have a compact structure by arranging the gasket.

In the embodiment, the number of the light shade adjustment wheels is eight, and the eight light shade adjustment wheels are divided into four groups which respectively control the four shading blades.

The stage light shading device provided by the embodiment can plug and play, quickly realize the shading of stage light, and is flexible and convenient to operate with obvious stability effect.

The utility model also provides a stage light which includes a light source and the stage light shading device corresponding to the light source. When the light beam emitted by the light source passes through the stage light shading device, the stage light shading device cuts and forms the light beam to achieve a target lighting effect.

The technical features of the above embodiment can be combined at random, and not all possible combinations of the technical features in the above embodiment are described in order to simplify the description. However, the combinations of these technical features should all be deemed within the scope of the specification as long as there is no contradiction among the combinations.

The above embodiment only expresses several implementations of the utility model. The descriptions thereof are specific and detailed, but they should not be construed as limiting the scope of the utility model. It should be noted that modifications and improvements can be made by those of ordinary skill in the art without departing from the spirit of the utility model, and all these modifications and improvements fall within the scope of the utility model. Therefore, the scope of the utility model should be subject to the appended claims.

The invention claimed is:

1. A stage light shading device, comprising: a light shade, light shade adjustment wheels for adjusting a shading pattern of the light shade, the light shade adjustment wheels disposed at a side of the light shade, a cover plate disposed at the side of the light shade and rotatably coupled with the light shade and movable between open and closed positions, and an elastic fastening component provided on the cover plate and contacting and fixing the light shade adjustment wheels, wherein when the cover plate is in the closed position, the elastic fastening component directly presses against the adjustment wheel to prevent the adjustment wheels from misoperating, wherein an end of the cover plate is pivotally coupled with the light shade.

2. The stage light shading device according to claim 1, wherein the elastic fastening component is an elastic strip.

3. The stage light shading device according to claim 2, wherein the elastic strip is a silicone elastic strip, a rubber elastic strip or an elastomer strip.

4. The stage light shading device according to claim 2, wherein the elastic strip has a thickness of 0.5 to 5 mm.

5. The stage light shading device according to claim 1, wherein the light shade includes a panel, a sandwiched plate and a bottom plate which are sequentially provided in a layered relationship through a connecting pole; a first light passing hole, a second light passing hole and a third light passing hole, which are used for a light beam to pass through, are respectively provided on the panel, the sandwiched plate and the bottom plate; shading blades and a linkage mechanism are further provided on the bottom plate; and the light shade adjustment wheels drive the shading blades through the linkage mechanism to move and cover the third light passing hole to form the shading pattern.

6. The stage light shading device according to claim 5, wherein the number of the shading blades is four and the shading blades are symmetrically provided.

7. The stage light shading device according to claim 5, wherein a gasket is respectively provided between the panel and the sandwiched plate, and the sandwiched plate and the bottom plate.

8. The stage light shading device according to claim 5, wherein the number of the light shade adjustment wheels is eight.

9. The stage light shading device according to claim 1, wherein a connector coupled with the light shade is provided on the cover plate.

10. A stage light system, comprising: a light source and a stage light shading device according to claim 1 corresponding to the light source.

* * * * *